United States Patent [19]

Corfield

[11] 4,289,001

[45] Sep. 15, 1981

[54] KEY-OPERATED DEVICE FOR ACCESS CONTROL SYSTEM

[75] Inventor: John C. Corfield, Lacey Green, England

[73] Assignee: Unimax Switch Limited, Maidenhead, England

[21] Appl. No.: 112,329

[22] Filed: Jan. 15, 1980

[30] Foreign Application Priority Data

Jan. 26, 1979 [GB] United Kingdom ..... 2813/79

[51] Int. Cl.[3] ..... E05B 15/06

[52] U.S. Cl. ..... 70/346; 70/347; 70/409

[58] Field of Search ..... 70/345, 346, 347, 344, 70/408, 409

[56] References Cited

U.S. PATENT DOCUMENTS 1,553,639 9/1925 Sherman ..... 70/408

1,888,918 11/1932 Godden ..... 70/408

FOREIGN PATENT DOCUMENTS 773884 5/1957 United Kingdom ..... 70/347

*Primary Examiner*—Robert L. Wolfe

*Attorney, Agent, or Firm*—Scrivener, Clarke, Scrivener and Johnson

[57] ABSTRACT

A key-operated device, for example for controlling access to switch gear or potentially dangerous machinery, has a rotary motion with an axially inserted key but departs from the usual barrel lock construction which is sensitive to foreign matter. Instead it has a faceplate in front of a stationary body with a cylindrical member rotatable in it and having a recess for the key and circumferentially spaced notches in a flange close behind the plate and prevented from direct access through the keyhole by a fixed axially extending wall on the back of the plate but accessible by appropriate lugs on the key when the latter is inserted. The rotatable member is connected through a spindle to a switch, valve or latch or other actuated device.

7 Claims, 4 Drawing Figures

KEY-OPERATED DEVICE FOR ACCESS CONTROL SYSTEM

This invention relates to a key-operated device for use in access control systems to control access to potentially dangerous plant machinery or work areas and simultaneously to control the issue of a warning and/or to control the operating state of the plant or machinery or work areas so that access is only obtained after they are rendered safe, for example, by disconnecting power to them.

Key-operated devices commonly used in access control systems incorporate a cylinder lock of the conventional type in which a set of slidable pins engage between the cylinder and fixed lock body to hold the cylinder against rotation, and in which the key is profiled so that insertion or initial rotation of the key shifts the pins to free the cylinder so that it can be rotated by the key, rotation of the cylinder or an associated spindle serving to operate the access control system.

The use of cylinder locks in these known key-operated devices provides a high degree of security against unauthorised access, but cylinder locks are vulnerable to the infiltration of foreign matter, and because of the large number of small moving parts that they contain, they are liable to jamming, corrosion and contamination when used in environments where they are exposed to production waste such as oils, swarf, fibres and food stuff.

An object of the present invention is to provide a key-operated device which offers a sufficient degree of security for an access control system, and which has improved resistance to jamming and corrosion and is sufficiently simple and robust to be readily cleaned or decontaminated by high-pressure water or steam.

The present invention consists in a key-operated device comprising a fixed body including a plate having a key-hole for the insertion of a key into the body, and a rotatable member mounted within the fixed body for engagement and rotation by the key, the rotatable member having a recess to receive the end of the key and an annular flange that partially closes the recess adjacent to the key-hole and in which one or more notches are formed to receive one or more corresponding lugs on the key, by means of which the key rotates the rotatable member, and the plate having a wall around the key-hole that projects inwards of the fixed body into the aperture at the centre of the annular flange so as to lie adjacent the inner peripheral edge of that flange, thereby to hinder the use of anything other than the appropriate key to engage the notch or notches and rotate the rotatable member. The profile of the key-hole is formed with one or more notches to match the notches in the annular flange for insertion of the key, and the lug or lugs on the key is or are offset from and project parallel to the axis of rotation of the key so as to engage the notch or notches in the annular member and rotate behind the wall around the key-hole.

The key-operated device according to the invention does not incorporate a lock such as the cylinder lock in the known devices, but it offers a sufficient degree of security against unauthorised operation by anything other than the appropriate key, and its simplicity of design means that it can be constructed so that it is robust and readily cleaned or decontaminated, and is composed of non-corrosive hard wearing materials.

Preferably, the device according to the invention further includes a guide member rotatably mounted in the recess in the rotatable member and having a pin that projects from the disc axially into the key-hole so as to engage a central bore in the end of the key. This pin guides insertion and rotation of the key, and also further hinders unauthorised operation by reducing the space available for the insertion of a tool into the key-hole. Preferably it projects far enough for its free end to lie substantially flush with the outer surface of the plate.

The invention will now be described by way of example with reference to the accompanying drawings, in which.

Figure 1:
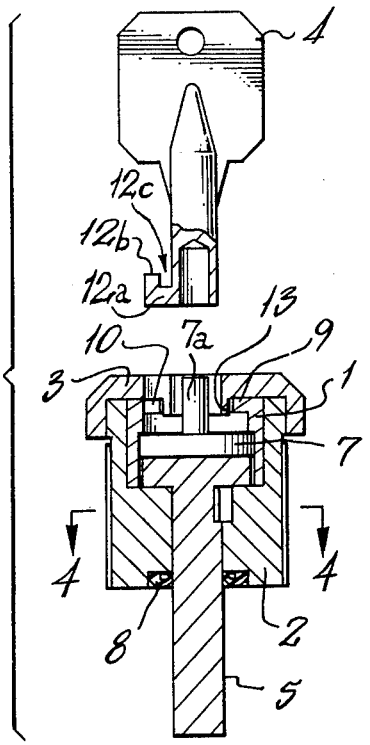
FIG. 1 shows a section through the body and a partly sectioned view of the key.
Figure 2:
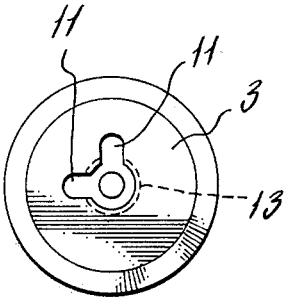
FIG. 2 is an external view of the body, looking axially.
Figure 3:
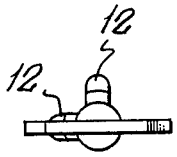
FIG. 3 is an end-view of the key.
Figure 4:
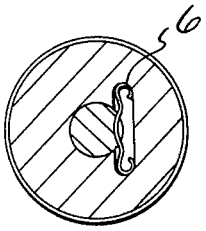
FIG. 4 is a section through the body on the line 4—4 in FIG. 3.

The illustrated embodiment comprises a key-hole plate 3 connected to a cylindrical body 2 formed with a central cylindrical recess in communication with the key-hole. A hollow cylindrical member 1 is rotatably mounted in the recess and is keyed to a spindle 5 at its lower end by interlocking lugs and notches, and has an annular, inwardly projecting flange 9 at its upper end adjacent the key-hole.

The flange 9 is formed with two inwardly opening notches 10 spaced 90° apart, and these match two similar notches 11 formed in the profile of the key-hole, the two pairs of notches being aligned for insertion of the key 4, as shown in the drawing. The key is formed with a pair of lugs 12 set 90° apart so as to co-operate with the notches 11 and 12. An axially inwardly extending wall 13 is formed around the circular portions of the key-hole so as to project into the central aperture formed by the flange 9 and to lie adjacent the inner peripheral edge of the flange. The wall 13 extends axially beyond the flange. Each lug 12 is of hook-like shape, comprising a radially projecting portion **12*a* and then, extending axially away from the outer end of that portion, a portion 12*b*. The portion 12*b* extends parallel to, but offset from, the axis of the key, in a direction away from the adjacent end of the key, to leave a gap 12*c* that allows the lug to clear the wall 13 as the key is turned, yet engage the associated notch 10 in the flange 9 to transmit torque to the member 1**.

A guide member 7 comprising a disc with a projecting pin **7*a* is mounted within the cylindrical member 1 so that the disc abuts the spindle 5 and the pin projects axially into the key-hole. A corresponding bore is formed in the end of the key 4 to receive the pin when the key is inserted. The guide member 7 is freely rotatable with respect to the member 1, so that any rotation imparted to the guide member is not transmitted to the member 1**.

A spring 6 is located in a slot in the body 2 so as to co-operate with the spindle 5 and hold the spindle and the cylindrical member 1 in the position for insertion of the key.

It will be appreciated that the presence of the wall 13, the narrowness of the notches 10, 11, the thickness of the key-hole plate 3, and the presence of the central pin 7, all combine to hinder access to the notches 10 by anything, other than the appropriate key, which will be strong enough to rotate the cylindrical member 1 and spindle 5.

It will also be appreciated that different devices with differently coded keys can be simply provided by varying the dimensions of the key and of corresponding parts of the device. For example, the number and angular positions of the lugs 12 can be varied with appropriate changes in the number and angular positions of the notches 10, 11.

In use in an access control system, rotation of the spindle is used to control devices, such as locking devices, warning devices and power disconnection devices. It could for example control and electric switch or a pneumatic or hydraulic valve. The key may be transportable or may form part of the machine mechanism, or it could be mounted rotatably on an operable guard.

If the spindle operates an electrical switch or other potentially dangerous device, it could be mounted in the wall of a sealed enclosure containing the switch, the outer cylindrical surface of the body 2 possibly being screw-threaded for engagement by a nut and being formed with locating flats or splines. A water-proof shaft-seal 8 is preferably fitted to prevent the egress of liquid from the device and into the sealed enclosure after entering through the key-hole.

I claim:

1. A key-operated device comprising a fixed hollow body having a plate-like wall, said wall having therein a key-hole for the admission of an end of a key inserted on an axis traversing said wall and passing through said key-hole, an actuating member mounted within said body to be rotatable about said axis, said member having therein a recess open towards said key-hole and having at that end thereof which is adjacent said plate-like wall an annular flange directed inwardly towards said axis, said flange having an innermost edge and having at least one notch formation capable of being engaged to transmit torque to said flange to rotate said member, a basically cylindrical wall provided on said body around said key-hole and extending axially inwardly from said plate-like wall to overlie said innermost edge of said flange on said member, a key comprising a stem lying on an axis and at least one lug projecting laterally from said stem and including a portion extending parallel to but offset from the axis of said stem, said stem being adapted to enter said key-hole, and said plate-like wall and axially extending wall being shaped to provide clearance for said lug, whereby on insertion of said key into said key-hole said axially extending portion of said lug can be caused to enter said body and said recess in said member and to engage said notch in said flange in a position radially outwards of said axially extending wall to transmit torque to said flange in order to rotate said member about said axis.

2. The device set forth in claim 1 wherein said shaping of said plate-like wall and axially extending wall comprise notches therein matching said lug.

3. The device set forth in claim 2 including detent means on said body, said detent means acting to urge said actuating member towards an angular position about said axis wherein said notch in said flange is aligned with the notches in said walls to allow admission of said key.

4. The device set forth in claim 1 further comprising a guide member, said guide member being captively mounted within said recess in said actuating member but free for relative rotation about said first mentioned axis and including a pin extending along said first axis towards said key-hole, and said key having in said stem an axially extending recess adapted to fit over said pin.

5. The device set forth in claim 3 wherein said pin extends substantially to the plane of said plate-like wall.

6. The device set forth in claim 1 wherein said actuating member includes an actuating spindle projecting axially from the opposite end of said body from said key-hole.

7. The device set forth in claim 1 wherein said key has a second said lug projecting from said stem in a different direction from said first-mentioned lug and said flange has therein a second notch adapted to be engaged by said second lug when said first-mentioned notch is engaged by said first mentioned lug.

* * * * *